US009085142B2

(12) United States Patent
Ono et al.

(10) Patent No.: US 9,085,142 B2
(45) Date of Patent: Jul. 21, 2015

(54) METHOD OF MANUFACTURING LIQUID EJECTION HEAD, AND LIQUID EJECTION HEAD

(71) Applicant: CANON KABUSHIKI KAISHA, Tokyo (JP)

(72) Inventors: Takayuki Ono, Kawasaki (JP); Masao Furukawa, Yokohama (JP); Masashi Ishikawa, Chofu (JP); Jun Hinami, Kawasaki (JP); Takeshi Shibata, Yokohama (JP); Ryo Shimamura, Yokohama (JP); Takanori Enomoto, Tokyo (JP); Shimpei Otaka, Kawasaki (JP); Tomohiro Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/167,919

(22) Filed: Jan. 29, 2014

(65) Prior Publication Data

US 2014/0218445 A1 Aug. 7, 2014

(30) Foreign Application Priority Data

Feb. 1, 2013 (JP) ..... 2013-018309

(51) Int. Cl.

| | |
|---|---|
| ***B41J 2/14*** | (2006.01) |
| ***B41J 2/05*** | (2006.01) |
| ***B41J 2/16*** | (2006.01) |

(52) U.S. Cl.

CPC ..... *B41J 2/14024* (2013.01); *B41J 2/1603* (2013.01); *B41J 2/1623* (2013.01)

(58) Field of Classification Search

USPC ..... 347/9, 20, 40, 44, 85, 86, 87, 47, 63–65

See application file for complete search history.

(56) References Cited

U.S. PATENT DOCUMENTS

| | | | | |
|---|---|---|---|---|
| 6,257,703 | B1 * | 7/2001 | Hirosawa et al. | 347/50 |
| 6,652,702 | B2 * | 11/2003 | Miyazaki et al. | 156/272.2 |
| 7,980,676 | B2 * | 7/2011 | Hirosawa et al. | 347/65 |
| 8,141,995 | B2 * | 3/2012 | Yamamoto et al. | 347/85 |
| 8,201,923 | B2 * | 6/2012 | Fujii | 347/47 |
| 8,500,252 | B2 * | 8/2013 | Shibata | 347/65 |

FOREIGN PATENT DOCUMENTS

JP 2009-298108 A 12/2009

* cited by examiner

*Primary Examiner* — Anh T. N. Vo

(74) *Attorney, Agent, or Firm* — Canon USA Inc. IP Division

(57) ABSTRACT

There is provided a method of manufacturing a liquid ejection head that includes a supporting member having a major surface provided with a plurality of supply paths, and a recording element substrate having a bonding surface bonded to the major surface and provided with a plurality of supply ports arranged side by side in an arranging direction in which the supply paths are arranged side by side, the supply ports having smaller widths than the respective supply paths in the arranging direction. The method includes applying a bonding agent on the major surface around each of the supply paths, spreading the bonding agent to inner side surfaces of the supply ports by pressing boundary portions between the bonding surface and the supply ports into the bonding agent applied, and bonding the bonding surface to the major surface at a bonding position where the supply ports face the respective supply paths.

7 Claims, 6 Drawing Sheets

METHOD OF MANUFACTURING LIQUID EJECTION HEAD, AND LIQUID EJECTION HEAD

BACKGROUND OF THE INVENTION

1. Field of the Invention

The present invention relates to a method of manufacturing a liquid ejection head in which a recording element substrate having supply ports is fixed to a supporting member having supply paths with a bonding agent, and also relates to a liquid ejection head.

2. Description of the Related Art

A known liquid ejection head includes a supporting member having supply paths, and a recording element substrate having supply ports. The recording element substrate is fixed to the supporting member with a bonding agent such that the supply ports face (communicate with) the supply paths.

FIG. 5 is an exploded perspective view of a related-art liquid ejection head 100 disclosed by Japanese Patent Laid-Open No. 2009-298108. FIG. 6 is a sectional view of a part of the liquid ejection head 100 illustrated in FIG. 5. The liquid ejection head 100 illustrated in FIG. 5 includes a supporting member 110 and a recording element substrate 120. The supporting member 110 has a plurality of supply paths 111 arranged side by side in an arranging direction D (see FIG. 5). The recording element substrate 120 has a plurality of supply ports 121 (see FIG. 6) arranged side by side in the arranging direction D.

As illustrated in FIG. 5, a bonding agent 130 is applied around each of the supply paths 111. The bonding agent 130 fixes the recording element substrate 120 to the supporting member 110 such that the supply ports 121 face (communicate with) the respective supply paths 111 (see FIG. 6).

In manufacturing the recording element substrate 120, the supply ports 121 may be formed in any of different manners. For example, if a method such as laser processing or sandblasting is employed, supply ports 121 each having a small width in the arranging direction D are formed.

If the widths of the supply ports 121 are smaller than the widths of the supply paths 111 in the arranging direction D, a width H1 of a bonding surface between adjacent ones of the supply ports 121 is larger than a width H2 of a bonding surface between adjacent ones of the supply paths 111 (see FIG. 6). In such a case, the bonding agent 130 on the recording element substrate 120 is present only on one surface (the bottom face) (see FIG. 6). In such a bonding method, the force of bonding the recording element substrate 120 to the supporting member 110 is small, and the recording element substrate 120 may be detached from the supporting member 110.

The present invention provides a method of manufacturing a liquid ejection head in which a recording element substrate having supply ports of small widths is firmly bonded to a supporting member, and also provides a liquid ejection head.

SUMMARY OF THE INVENTION

According to an aspect of the present invention, there is provided a method of manufacturing a liquid ejection head that includes a supporting member having a major surface provided with a plurality of supply paths, and a recording element substrate having a bonding surface bonded to the major surface and provided with a plurality of supply ports arranged side by side in an arranging direction in which the supply paths are arranged side by side, the supply ports having smaller widths than the respective supply paths in the arranging direction. The method includes applying a bonding agent on the major surface around each of the supply paths, spreading the bonding agent to inner side surfaces of the supply ports by pressing boundary portions between the bonding surface and the supply ports into the bonding agent applied, and bonding the bonding surface to the major surface at a bonding position where the supply ports face the respective supply paths.

According to another aspect of the present invention, there is provided a liquid ejection head including a supporting member having a major surface provided with a plurality of supply paths, and a recording element substrate having a bonding surface bonded to the major surface and provided with a plurality of supply ports arranged side by side in an arranging direction in which the supply paths are arranged side by side, the supply ports having smaller widths than the respective supply paths in the arranging direction. The bonding surface is bonded to the major surface with a bonding agent such that the supply ports face the respective supply paths and such that the bonding agent is present on inner side surfaces of the supply ports.

Further features of the present invention will become apparent from the following description of exemplary embodiments with reference to the attached drawings.

DESCRIPTION OF THE EMBODIMENTS

Figure 1:
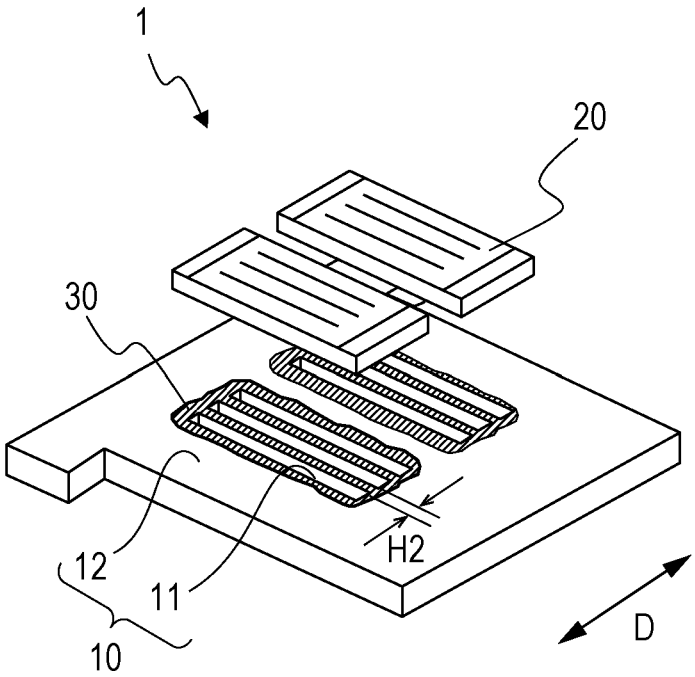
FIG. 1 is an exploded perspective view of a liquid ejection head according to an embodiment of the present invention.

FIG. 1 is an exploded perspective view of a liquid ejection head 1 according to an embodiment of the present invention. The liquid ejection head 1 according to the embodiment is of a thermal-inkjet type, in which a liquid such as ink is ejected in accordance with electrical signal input by using electrothermal conversion members that generate thermal energy for causing film boiling. The liquid ejection head 1 according to the embodiment is also of a side-shooter type, in which electrothermal conversion members face ink ejection ports. The liquid ejection head 1 according to the embodiment will now be described with reference to the attached drawings.

As illustrated in FIG. 1, the liquid ejection head 1 according to the embodiment includes a supporting member 10 and a recording element substrate 20 bonded to the supporting member 10 with a bonding agent 30. The supporting member 10 has a major surface 12 provided with a plurality of supply paths 11. In the embodiment, the supporting member 10 is a ceramic substrate.

Figure 2:
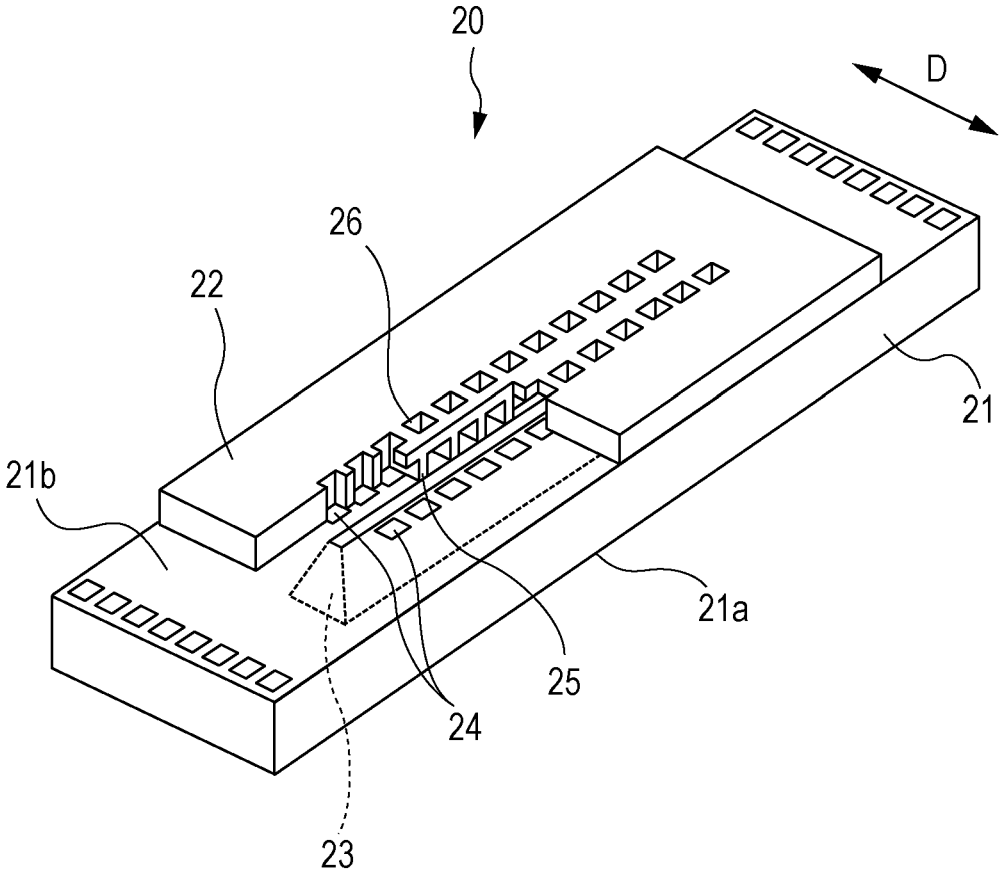
FIG. 2 is a perspective view of a recording element substrate illustrated in FIG. 1.

FIG. 2 is a perspective view of the recording element substrate 20 illustrated in FIG. 1. To illustrate an internal configuration of the recording element substrate 20, FIG. 2 illustrates the recording element substrate 20 with an internal part thereof exposed. As illustrated in FIG. 2, the recording element substrate 20 includes a silicon substrate 21 and an orifice plate 22 joined to the silicon substrate 21.

The silicon substrate 21 has groove-type supply ports 23. Although FIG. 2 only illustrates one supply port 23, a plurality of supply ports 23 are arranged side by side in an arranging direction D, actually. The supply ports 23 each extend through the silicon substrate 21 from a bonding surface 21*a* to a surface 21*b* that is opposite the bonding surface 21*a*. The widths of the supply ports 23 are smaller than the widths of the supply paths 11 in the arranging direction D. The supply ports 23 are formed by a method such as anisotropic etching utilizing the crystal orientation of silicon, or sandblasting.

The silicon substrate 21 has a plurality of electrothermal conversion elements 24 provided on the surface 21*b* thereof such that two rows of electrothermal conversion elements 24 are arranged on two respective sides of each of the supply ports 23. Wiring (not illustrated) via which power is supplied to the electrothermal conversion elements 24 is also provided on the surface 21*b*. The electrothermal conversion elements 24 and the wiring may be formed by known film forming techniques.

The orifice plate 22 has ejection ports 26 provided in a surface thereof (a surface opposite a surface joined to the silicon substrate 21) and facing the respective electrothermal conversion elements 24. Adjacent ones of the ejection ports 26 are separated by an ink passage wall 25.

In the liquid ejection head 1 configured as above, ink flows from the supply paths 11 (see FIG. 1) into the respective supply ports 23 (see FIG. 2), and is ejected from the ejection ports 26 with a pressure applied thereto by bubbles produced by heat generated by the electrothermal conversion elements 24.

In the embodiment, the two rows of electrothermal conversion elements 24 arranged on both sides of each of the supply ports 23 are staggered with respect to each other (see FIG. 2). That is, two rows of ejection ports 26 residing across the supply port 23 from each other are staggered with respect to each other in a direction in which the ejection ports 26 are lined up (in a direction orthogonal to the arranging direction D).

A method of manufacturing the liquid ejection head 1 according to the embodiment will now be described. FIGS. 3A and 3B and 4A to 4H illustrate steps of manufacturing the liquid ejection head 1 according to the embodiment.

Figure 3A:
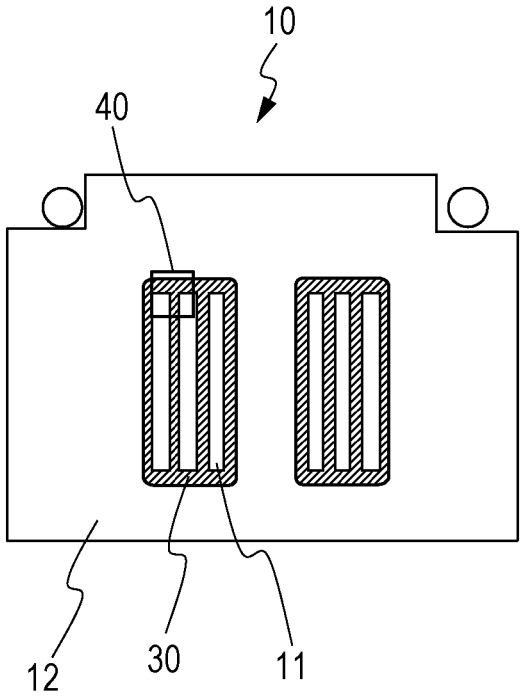
FIGS. 3A and 3B illustrate steps of manufacturing the liquid ejection head according to the embodiment.

First, referring to FIG. 3A, the bonding agent 30 is applied to the major surface 12 of the supporting member 10 around each of the supply paths 11. The bonding agent 30 may have low viscosity, low curing temperature, short curing time, high hardness, and high ink resistance. Examples of the bonding agent 30 having such characteristics include a thermosetting bonding agent chiefly composed of epoxy resin.

Figure 3B:
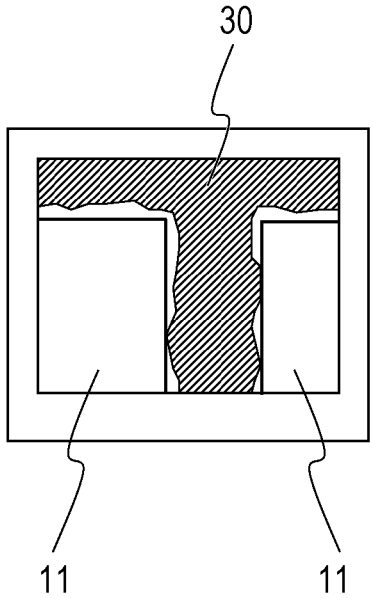
Figure 4A:
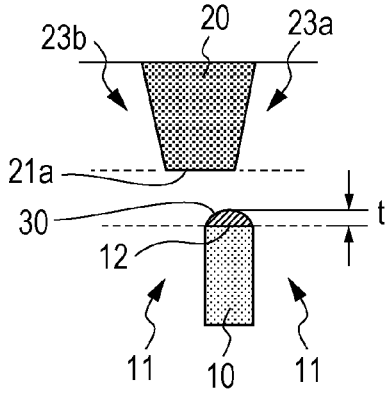
FIGS. 4A to 4H illustrate other steps of manufacturing the liquid ejection head according to the embodiment.

FIG. 3B is an enlarged view of a area 40 illustrated in FIG. 3A. In the embodiment, an imaging device (not illustrated) takes an image such as the one illustrated in FIG. 3B. The imaging device is connected to an image processing device (not illustrated). On the basis of the thus taken image, the image processing device detects an area having the bonding agent 30 that has been defined between adjacent supply paths 11. The image processing device is connected to a transporting device (not illustrated) that transports the recording element substrate 20. The transporting device adjusts the position of the recording element substrate 20 on the basis of the area having the bonding agent 30 that has been detected by the image processing device. In the embodiment, as illustrated in FIG. 4A, the recording element substrate 20 is positioned such that a boundary portion between a supply port 23*a*, which is one of the plurality of supply ports 23, and the bonding surface 21*a* resides above the area having the bonding agent 30.

Figure 4B:
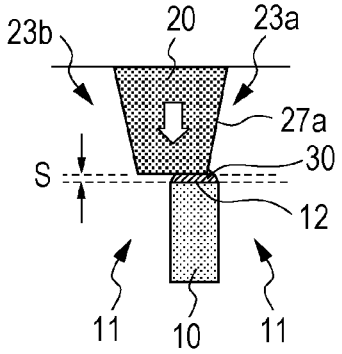

Subsequently, as illustrated in FIG. 4B, the recording element substrate 20 is brought close to (lowered toward) the supporting member 10 by the transporting device. The recording element substrate 20 is stopped at a position where a gap S (see FIG. 4B) between the major surface 12 and the bonding surface 21*a* reaches a predetermined value. A thickness t of the bonding agent 30 applied in the step illustrated in FIG. 4A is larger than the gap S. With the lowering of the recording element substrate 20, the boundary portion between the supply port 23*a* and the bonding surface 21*a* is pressed into the bonding agent 30, whereby the bonding agent 30 is spread to an inner side surface 27*a* of the supply port 23*a* that adjoins the bonding surface 21*a*.

Figure 4C:
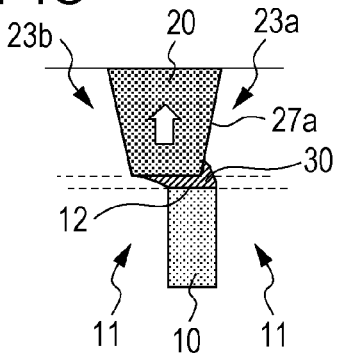
Figure 4D:
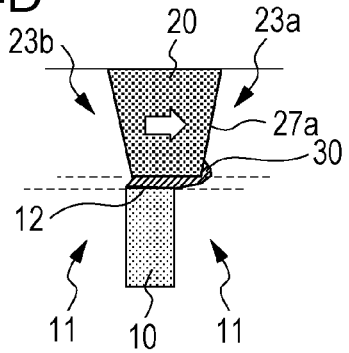
Figure 4E:
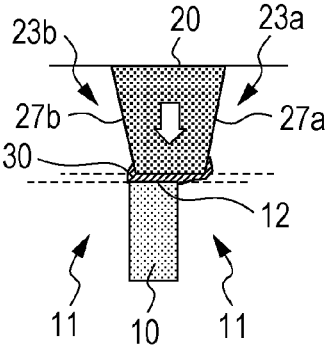
Figure 4F:
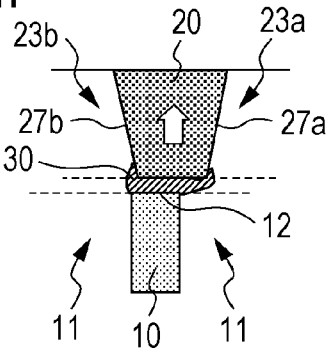

Subsequently, as illustrated in FIG. 4C, the recording element substrate 20 is lifted temporarily. Then, as illustrated in FIG. 4D, the recording element substrate 20 is moved toward one side in the arranging direction D. Consequently, the recording element substrate 20 is positioned such that a boundary portion between a supply port 23*b*, which is adjacent to the supply port 23*a*, and the bonding surface 21*a* resides above the area having the bonding agent 30.

Subsequently, the recording element substrate 20 is lowered again (see FIG. 4E), as in the step illustrated in FIG. 4B. With the lowering of the recording element substrate 20, the boundary portion between the supply port 23*b* and the bonding surface 21*a* is pressed into the bonding agent 30, whereby the bonding agent 30 is spread to an inner side surface 27*b* of the supply port 23*b* that adjoins the bonding surface 21*a* (see FIG. 4E).

Figure 4G:
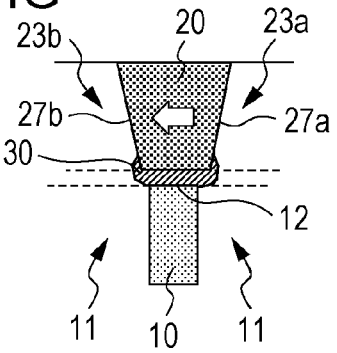
Figure 4H:
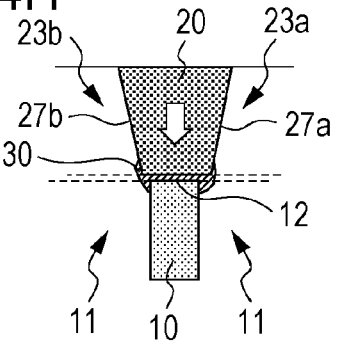
Figure 5:
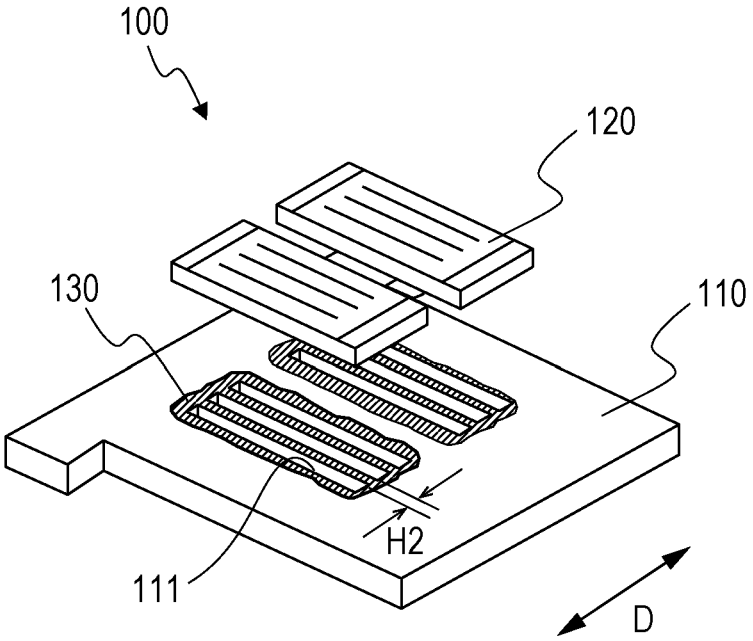
FIG. 5 is an exploded perspective view of a related-art liquid ejection head.

Subsequently, the recording element substrate 20 is lifted again (see FIG. 4F), as in the step illustrated in FIG. 4C. Subsequently, as illustrated in FIG. 4G, the recording element substrate 20 is moved toward the other side in the arranging direction D. Lastly, the recording element substrate 20 is lowered and is thus bonded to the supporting member 10 at a bonding position where the plurality of supply ports 23 face the plurality of supply paths 11, respectively (see FIG. 4H).

Figure 6:
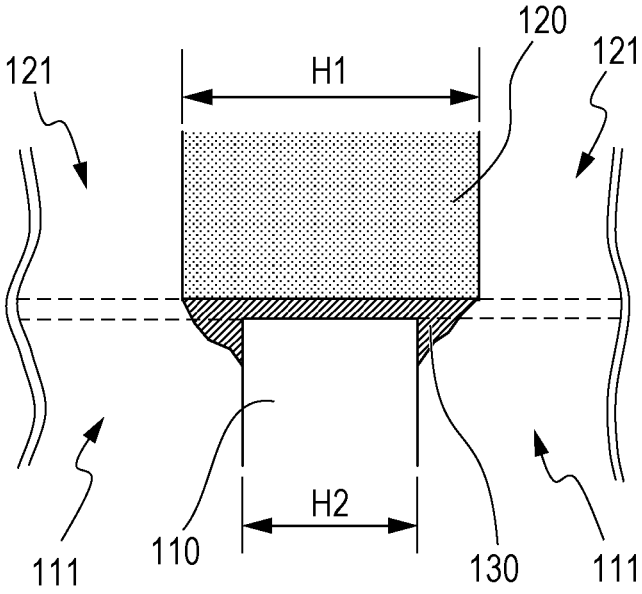
FIG. 6 is a sectional view of a part of the liquid ejection head illustrated in FIG. 5.

In the liquid ejection head 1 according to the embodiment, even if the widths of the supply ports 23 are smaller than the widths of the supply paths 11 in the arranging direction D, the bonding agent 30 is spread to (i.e., the bonding agent 30 is made to adhere to) the inner side surfaces of the supply ports 23. Hence, the recording element substrate 20 is bonded to the supporting member 10 more firmly than in the case of the related-art configuration illustrated in FIG. 6.

According to the embodiment of the present invention, it is possible to firmly fix a recording element substrate having supply ports of small widths to a supporting member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-018309, filed Feb. 1, 2013, which is hereby incorporated by reference herein in its entirety.

What is claimed is:

1. A method of manufacturing a liquid ejection head that includes a supporting member having a major surface provided with a plurality of supply paths, and a recording element substrate having a bonding surface bonded to the major surface and provided with a plurality of supply ports arranged side by side in an arranging direction in which the supply paths are arranged side by side, the supply ports having smaller widths than the respective supply paths in the arranging direction, the method comprising:

applying a bonding agent on the major surface around each of the supply paths;

spreading the bonding agent to inner side surfaces of the supply ports by pressing boundary portions between the bonding surface and the supply ports into the bonding agent applied;

moving the recording element substrate and the supporting member that are connected to each other with the bonding agent relative to each other in a first direction along the major surface; and bonding the bonding surface to the major surface at a bonding position where the supply ports face the respective supply paths.

2. The method of manufacturing a liquid ejection head according to claim 1, wherein the spreading of the bonding agent is performed by bringing the recording element substrate close to the supporting member such that a gap between the major surface and the bonding surface reaches a predetermined value.

3. The method of manufacturing a liquid ejection head according to claim 2, wherein the bonding agent applied in the applying of the bonding agent has a thickness larger than the gap.

4. The method of manufacturing a liquid ejection head according to claim 1, wherein the recording element substrate is moved to the bonding position by temporarily lifting the recording element substrate in a transition from the spreading of the bonding agent to the bonding of the bonding surface to the major surface.

5. The method of manufacturing a liquid ejection head according to claim 1, further comprising, after the moving of the recording element substrate and the supporting member relative to each other in the first direction, moving the recording element substrate and the supporting member that are connected to each other with the bonding agent relative to each other in a direction away from each other.

6. The method of manufacturing a liquid ejection head according to claim 1, further comprising, after the moving of the recording element substrate and the supporting member relative to each other in the first direction, moving the recording element substrate and the supporting member that are connected to each other with the bonding agent relative to each other in a second direction that is opposite to the first direction.

7. The method of manufacturing a liquid ejection head according to claim 6, further comprising, after the moving of the recording element substrate and the supporting member relative to each other in the second direction, moving the recording element substrate and the supporting member that are connected to each other with the bonding agent relative to each other in a direction toward each other.

* * * * *